US008130063B2

(12) United States Patent
Chen et al.

(10) Patent No.: US 8,130,063 B2
(45) Date of Patent: Mar. 6, 2012

(54) WAVEGUIDE FILTER

(75) Inventors: Xiao-Ping Chen, Montreal (CA); Ke Wu, Montreal (CA); Dan Drolet, Nepean (CA)

(73) Assignee: Her Majesty the Queen in right of Canada, as represented by The Secretary of State for Industry, Through the Communications Research Centre Canada, Ottawa (CA)

( * ) Notice: Subject to any disclaimer, the term of this patent is extended or adjusted under 35 U.S.C. 154(b) by 169 days.

(21) Appl. No.: 12/412,503

(22) Filed: Mar. 27, 2009

(65) Prior Publication Data

US 2009/0243762 A1 Oct. 1, 2009

Related U.S. Application Data

(60) Provisional application No. 61/039,942, filed on Mar. 27, 2008.

(30) Foreign Application Priority Data

Apr. 11, 2008 (CA) ..... 2629035

(51) Int. Cl.
*H01P 1/208* (2006.01)

(52) U.S. Cl. ..... 333/208; 333/212

(58) Field of Classification Search ..... 333/202, 333/208, 210, 212, 239, 248
See application file for complete search history.

(56) References Cited

U.S. PATENT DOCUMENTS

| | | | | |
|---|---|---|---|---|
| 5,382,931 | A | 1/1995 | Piloto et al. | 333/208 |
| 6,677,837 | B2 | 1/2004 | Kojima et al. | 333/208 |
| 6,977,566 | B2 * | 12/2005 | Fukunaga | 333/208 |
| 6,992,548 | B2 * | 1/2006 | Fukunaga | 333/208 |
| 7,142,074 | B2 | 11/2006 | Kim et al. | 333/208 |
| 7,196,598 | B2 | 3/2007 | Maruhashi et al. | 333/212 |
| 7,675,391 | B2 * | 3/2010 | Chuang et al. | 333/212 |

FOREIGN PATENT DOCUMENTS

| | | |
|---|---|---|
| CN | 200950463 Y | 9/2007 |
| EP | 1376746 B1 | 8/2006 |
| JP | 2002-135003 | 5/2002 |
| JP | 2002-171102 | 6/2002 |
| JP | 2003-163507 | 6/2003 |
| JP | 2004-274341 | 9/2004 |

OTHER PUBLICATIONS

Deslandes et al., "Single-Substrate Integration Technique of Planar Circuits and Waveguide Filter", IEEE Trans. on Microwave Theory & Techn., vol. 15, No. 2, Feb. 2003, pp. 593-596.*

(Continued)

*Primary Examiner* — Seungsook Ham
(74) *Attorney, Agent, or Firm* — Teitelbaum & MacLean; Neil Teitelbaum; Doug MacLean

(57) ABSTRACT

A waveguide bandpass filter for use in microwave and millimeter-wave satellite communications equipment is presented. The filter is based on a substrate integrated waveguide (SIW) having several cascaded oversized SIW cavities. The filter is implemented in a printed circuit board (PCB) or a ceramic substrate using arrays of standard metalized via holes to define the perimeters of the SIW cavities. Transmission lines of a microstrip line, a stripline or coplanar waveguide are used as input and output feeds. The transmission lines have coupling slots for improved stopband performance. The filter can be easily integrated with planar circuits for microwave and millimeter wave applications.

23 Claims, 16 Drawing Sheets

OTHER PUBLICATIONS

Deslandes et al., "Integrated Transition of Coplanar to Rectangular Waveguides", 2001 IEEE MTT-S Digest, 2001, pp. 619-622.*
Deslandes et al., "Substrate Integrated Waveguide Dual-Mode Fitlers for Broadband Wireless Systems", Radio and Wireless Conf., 2003 RAWCON '03 Proceedings, Aug. 2003, pp. 385-388.*
Chuang et al., "Design of Dual-Mode SIW Cavity Filters", TENCON 2007—2007 IEEE Region 10 Conference, Oct. 30-Nov. 2, 2007, pp. 1-4.*
Chen et al., "Substrate Integrated Waveguide Quasi-Elliptic Filter Using Extracted-Pole Technique", APMC2005 Proceedings, 2005, pp. 1-3.*
Hao et al., "A Broadband Substrate Integrated Waveguide (SIW) Filter", Antenna and Propagation Society International Symposium, 2005 IEEE, pp. 598-601.*
Cassivi et al., "Low-Cost and High-Q Millimeter-Wave Restonator Using Substrate Integrated Waveguide Technique", Microwave Conference, 2002, 32nd European, Sep. 2002, pp. 1-4.*
Chen et al., "Substrate Integrated Waveguide Cross-Coupled Filter With Negative Coupling Structure", IEEE Trans. on Microwave Theory & Techn. vol. 56, No. 1, Jan. 2008, pp. 142-149.*
K. Wu, "Integration and interconnect techniques of planar and non-planar structures for microwave and millimetre-wave circuits—Current status and future trend", in 2001 Asia-Pacific Microw. Conf., Taipei, Taiwan, R.O.C., Dec. 3-6, 2001, pp. 411-416.
F. Arndt, J. Bornemann, R. Vahldieck, and D. Grauerholz, "E-plane integrated circuit filters with improved stopband attenuation", IEEE Trans. Microw. Theory Tech., vol. MTT-32, No. 10, pp. 1391-1394, Oct. 1984.
R. Vahldieck and W. G. R. Hoefer, "Finline and metal insert filters with improved passband separation and increased stopband attenuation", IEEE Trans. Microw. Theory Tech., vol. MTT-33, No. 12, pp. 1333-1338, Dec. 1985.
D. Budimir, "Optimized E-plane bandpass filters with improved stopband performance", IEEE Trans. Microw. Theory Tech., vol. 45, No. 2, pp. 212-219, Feb. 1997.
M. Morelli, I. Hunter, R. Parry, and V. Postoyalko, "Stopband performance improvement of rectangular waveguide filters using stepped-impedance resonators", IEEE Trans. Microw. Theory Tech., vol. 50, No. 7, pp. 1654-1664, Jul. 2002.
J. D. Rhodes and R. J. Cameron, "General extracted poly synthesis technique with applications to low-loss $TE_{011}$ mode filters," IEEE Trans. Micro. Theory Tech., vol. MTT-28, No. 9, pp. 1018-1028, 1980.
R. Levy, "Filters with single transmission zeros at real and imaginary frequencies," IEEE Trans. Microw. Thoery Tech., vol. MTT-24, pp. 172-181, 1976.
F. Arndt, T. Duschak, U. Papziner, and P. Roalppe, "Asymmetric iris coupled cavity filters with stopbandpoles," in IEEE MTT-S Int. Microw. Symp. Dig., 1990, pp. 215-218.
K. Iguchi, M. Tsuji, and H. Shigesawa, "Negative coupling between TE and TE modes for use in evanescent-mode bandpass filters and their field-theoretic CAD", in IEEE MTT-S Int. Microw. Symp. Dig., 1994, pp. 727-730.
U. Rosenberg, W. Hagele, "Consideration of parasitic bypass coupling in overmoded cavity filter designs," IEEE Trans. Microw. Theory Tech., vol. 42, No. 7, pp. 1301-1306, 1994.
M. Guglielmi, F. Montauti, L. Pellegrini, and P. Arcioni, "Implementing transmission zeros in the inductive-window bandpass filters", IEEE Trans. Microw. Theory Tech., vol. 43, No. 8, pp. 191-1915, 1995.
S. Amari, U. Rosenberg, Characteristics of cross (bypass) coupling through higher/lower order modes and their applications in elliptic filter design', IEEE Trans. Microw. Theory Tech., vol. 53, No. 10, pp. 3135-3141, 2005.

* cited by examiner

WAVEGUIDE FILTER

CROSS-REFERENCE TO RELATED APPLICATIONS

The present invention claims priority from U.S. Provisional Patent Application No. 61/039,942, filed Mar. 27, 2008, and Canadian Patent Application No. 2,629,035, filed Apr. 11, 2008, which are incorporated herein by reference.

TECHNICAL FIELD

This invention relates to waveguide filters. More particularly, this invention relates to substrate integrated waveguide bandpass filters.

BACKGROUND OF THE INVENTION

An electrical bandpass filter is a fundamental element used for selecting an electrical signal in a frequency passband while suppressing electrical signals in a frequency stopband of the filter. Microwave and millimeter-wave bandpass filters are often used in modern radio-frequency transceivers. Filters having low in-band insertion loss, high spectral selectivity, and a wide stopband are commonly required. As an example, in a typical ground terminal for communication with satellites in the $K_a$ frequency band, a filter is required to suppress signals at transmission frequencies in a 29.5 GHz-30 GHz frequency range while conveying the signals at reception frequencies in a 19.2 GHz-21.2 GHz frequency range. An insertion loss of less than 1 dB and a stopband suppression level of at least 45 dB are desired to select the signal while avoiding self-jamming effects during simultaneous reception and transmission of electromagnetic signals by the ground terminal.

Microwave bandpass filters can be implemented as bulk waveguide structures. These are relatively heavy, bulky, and expensive; due to their size and weight, integration of bulk waveguide filters with planar components and electronic circuits can be a challenging task.

Substrate integrated waveguides (SIWs) are waveguide structures formed in a substrate of an electronic circuit. SIWs allow easy integration of planar circuits on a single substrate using a standard printed circuit board (PCB) or low-temperature co-fired ceramic (LTCC) process, or any other process of planar circuit fabrication. By using SIWs in an electronic circuit, the interconnection loss between components can be reduced. The size and the weight of the entire circuit can also be reduced.

SIW filters are known in the art. They offer a low-cost, low mass and compact size alternative to conventional waveguide filters, while maintaining high performance. Although various techniques have been implemented to improve the stopband performance of conventional rectangular waveguide filters, these techniques often utilize E-plane discontinuities that are difficult to realize for SIW filters implemented on a single-layer substrate. The SIW filters of the prior art have often been limited to resonant structures based on physical coupling elements to achieve a pre-selected spectral shape of the filter response function and/or high levels of stopband suppression. For example, a SIW filter designed to block an electromagnetic signal at a frequency $f_0$ has a slit in the top or bottom conducting layer to provide an attenuation pole at the frequency $f_0$.

Transmission zeros (TZs) in the insertion loss response of a microwave filter can be used to improve the spectral selectivity and the stopband attenuation of the filter. To generate the TZs, an "extracted pole" technique can be implemented to construct so called "bandstop" resonators. Alternatively, electrical couplings can be introduced between non-adjacent resonators, wherein the TZs are generated due to a phenomenon of multipath interference of electromagnetic waves propagating inside the resonators. However, such filters are usually constructed using conventional waveguide technology, which tends to use bulky and complex filter structures. Furthermore, the TZs implemented using these prior-art methods cannot be far away from the desired passband due to the limitation of the physical structure of a prior-art waveguide filter.

The present invention overcomes the above stated problems of the prior art. It provides a low-cost, high-performance SIW filter that is easy to integrate with planar circuits. Advantageously, the spectral shape of the SIW filter of the present invention can be adapted to provide a high level of attenuation away from a desired passband. Furthermore, SIW filters can offer a significant improvement in passive intermodulation performance over conventional filters.

SUMMARY OF THE INVENTION

According to the present invention, a substrate integrated waveguide (SIW) filter includes a chain of sequentially coupled conterminous multimode SIW cavities, of which the first and the last multimode SIW cavities can be directly excited by a transmission line. The entire filter is implemented using arrays of metalized via holes on a dielectric substrate. The via holes are produced by using a standard printed circuit board (PCB) or other planar circuit manufacturing process. The diameter of the via holes and the pitch between neighboring via holes are selected so as to suppress radiation losses in the SIW cavities. A desired passband is generated by the fundamental mode of propagation in the SIW cavities. The finite transmission zeros (TZs) are generated by destructive interference between the fundamental and a higher-order electromagnetic mode of the SIW cavities. The size and the shape of the SIW cavities are selected so that the TZs are far away from the passband, for high out-of-band rejection. The position of every finite TZ is independently controllable. The freedom of positioning the TZs is achieved by changing the inter-cavity coupling ratios and the size of corresponding multimode SIW cavities. According to the present invention, no other mode discriminating physical structures within the SIW cavities, such as openings in a conductive layer of the PCB, are required to control the position of the TZs.

In accordance with the invention there is provided a filter having a passband and a stopband, for conveying passband frequency components of an electromagnetic signal, while suppressing stopband frequency components of the electromagnetic signal, the filter comprising:

- an SIW formed in a planar dielectric layer sandwiched between first and second opposing planar conductive layers, the SIW having a chain of sequentially coupled conterminous multimode SIW cavities defined on their perimeters by an array of conductive vias connecting the first and the second conductive layers through the dielectric layer, the chain having first and second ends;
- an input transmission line coupled to the first end of the chain, for coupling the electromagnetic signal to the first end of the chain; and
- an output transmission line coupled to the second end of the chain, for outputting the passband frequency components of the electromagnetic signal from the second end of the chain;

wherein a distance between neighboring vias of the array of conductive vias is small enough to suppress radiation losses of the SIW, for example less than half of a shortest wavelength of the electromagnetic signal in the SIW cavities.

BRIEF DESCRIPTION OF THE DRAWINGS

Exemplary embodiments will now be described in conjunction with the drawings in which.

DETAILED DESCRIPTION OF THE INVENTION

While the present teachings are described in conjunction with various embodiments and examples, it is not intended that the present teachings be limited to such embodiments. On the contrary, the present teachings encompass various alternatives, modifications and equivalents, as will be appreciated by those of skill in the art. In FIGS. 6, 7, 8, 9A, and 9B, like numerals refer to like elements.

A waveguide filter of the present invention uses at least two electromagnetic modes, propagating or evanescent. A passband of the filter is defined by a frequency range at which only the fundamental mode appears at an output port of the filter. A stopband of the filter is defined by all frequencies outside of the passband. Within the stopband, higher-order modes may create spurious passbands. By carefully selecting the dimensions of the substrate integrated waveguide (SIW) cavity, one transmission zero (TZ) or multiple TZs can be generated at specific locations in the stopband to suppress these spurious passbands.

In general, the insertion loss of a filter is proportional to the number of resonators n, inversely proportional to the unloaded quality factor Qu of the resonator, and also the relative bandwidth FBW of the filter. For a small-ripple, less than 0.1 dB, Chebyshev filter, the increase in insertion loss $\Delta S_{21}$ at a center frequency $\omega_0$ is given by $$\Delta S_{21}(\mathrm{dB})|_{\omega=\omega_0} = \frac{4.343}{FBW}\sum_{i=1}^{n}\frac{g_i}{Qu_i} \tag{1}$$

wherein $g_i$ is a generalized low-pass prototype element (inductor or capacitor) value for an $i^{th}$ resonator.

The Qu of an SIW cavity is determined by three Q-factors, namely, the Q-factor related to lossy conducting walls Qc, the Q-factor related to dielectric loss D: Qd=1/tan(D), and the Q-factor related to energy leakage via gaps in the SIW cavity Qr. The unloaded quality factor is then expressed as $$1/Qu=1/Qc+1/Qd+1/Qr \tag{2}$$

As is known in the art, by properly selecting the SIW substrate materials and the shape of the filter, the radiation loss represented by 1/Qr can be made much smaller than the dielectric and conductive losses represented respectively by 1/Qd or 1/Qc. At $K_a$-band, the SIW cavity based on a conventional microwave dielectric substrate with a height of 20 mil and a dielectric loss tangent tan(D) of 0.0012 has a Qu of about 350, which is a typical quality factor of finline waveguide resonators. Therefore, a small number of SIW cavities, preferably four cavities, are used in a filter of the present invention to minimize insertion loss. The spectral selectivity of a filter of the present invention is improved by selecting SIW cavities of certain size and shape as will now be described.

Figure 1:
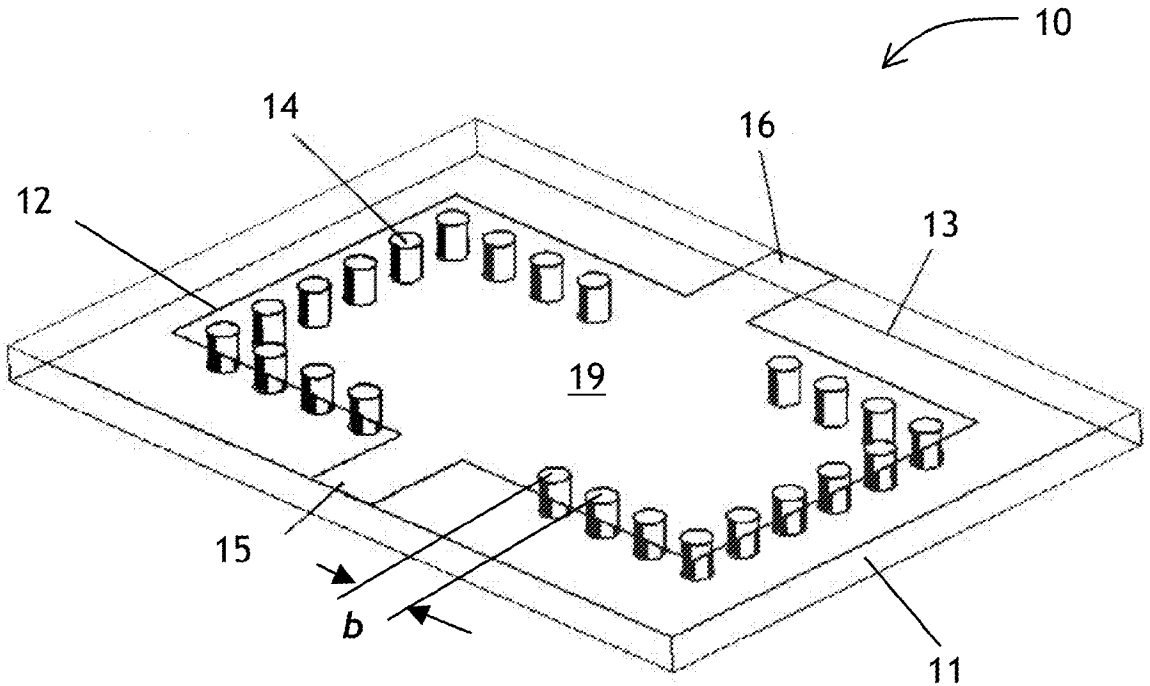
FIG. 1 is a three-dimensional view of a single-cavity substrate integrated waveguide (SIW) filter having opposing input and output microstrip transmission lines.

Referring to FIG. 1, a single-cavity SIW filter 10 is presented having a dielectric layer 11 sandwiched between a top planar conductive layer 12 and a bottom planar conductive layer 13. A SIW cavity 19 of the filter 10 is defined on the perimeter of the cavity 19 by an array of conductive vias 14 connecting the top and the bottom conductive layers 12 and 13 through the dielectric layer 11. The SIW cavity 19 is directly excited by one of symmetrical 50Ω microstrip lines 15 or 16. Due to the symmetry of the SIW cavity 19, it supports only $TE_{n0m}$ modes of propagation, wherein m is a positive number and n is an odd positive number. Preferably, the SIW cavity 19 is shaped and sized so as to support only two modes of propagation of the intended signal, the $TE_{101}$ mode and the $TE_{301}$ mode. The SIW filter 10 can be manufactured at a low cost using a standard printed circuit board (PCB) manufacturing process, or a low-temperature co-fired ceramic (LTCC) manufacturing process.

Throughout the specification, multimode SIW cavities are called, interchangeably, "oversized" cavities. This means that the size of the cavities can support more than one mode of propagation of an incoming signal. The SIW cavity 19 is termed herein as "oversized $TE_{101}/TE_{301}$ SIW cavity".

The distance b between neighboring vias 14 is small enough to suppress radiation losses of the SIW cavity 19. As a rule, the distance b should be less than one half of the shortest wavelength of the electromagnetic signal in the SIW cavity 19. The distance b for the cavity 19 of FIG. 1 is 1 mm, and the diameter d of the vias 14 is 0.5 mm. The overall size of the SIW cavity 19 is approximately 4.5 mm×10.5 mm for the given passband frequency range and the selected dielectric layer material Rogers RT/Duroid™ 6002. A central frequency $f_0$ of the passband is related to effective width $a_{eff}$ and length $l_{eff}$ of the SIW cavity 19 as follows:

$$f_0 = \frac{c_0}{2\sqrt{\varepsilon_r}}\sqrt{\left(\frac{1}{a_{eff}}\right)^2 + \left(\frac{1}{l_{eff}}\right)^2} \quad (3)$$

where $c_0$ is the speed of light in air, $a_{eff}=a-d^2/0.95b$, $l_{eff}=l-d^2/0.95b$, and where a and l are the geometrical width and length of the SIW cavity 19, respectively.

Figure 2:
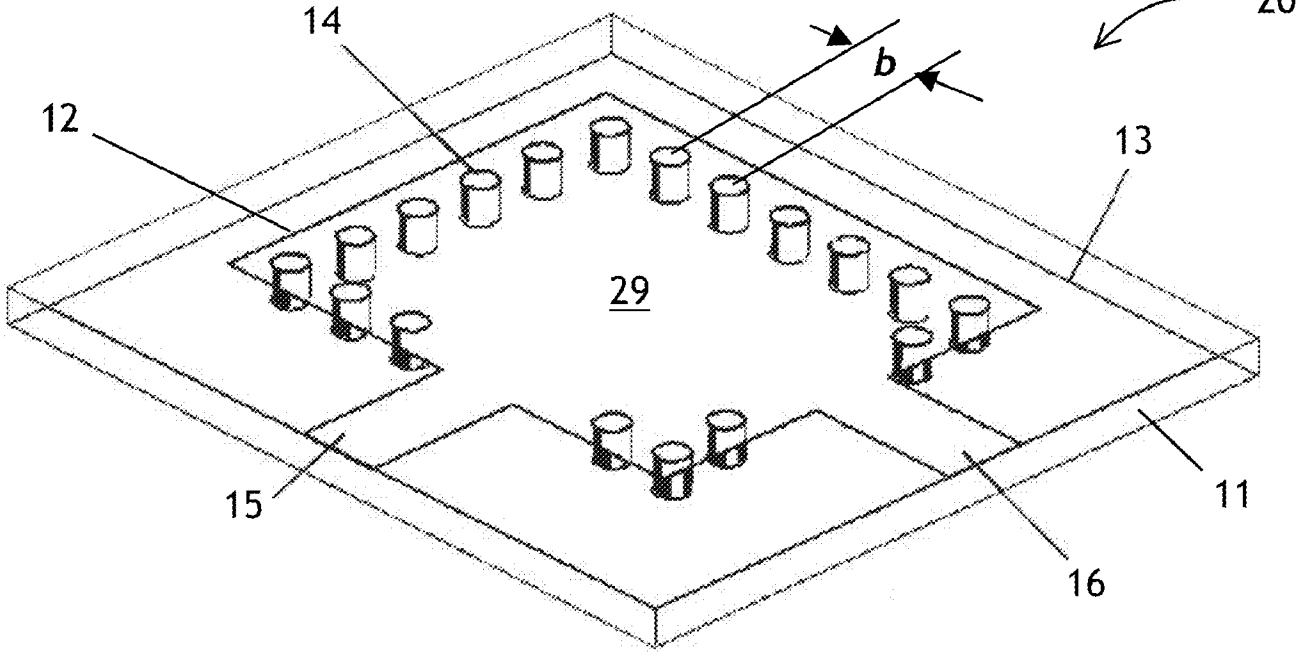
FIG. 2 is a three-dimensional view of a single-cavity SIW filter having input and output microstrip transmission lines disposed at 90° with respect to each other.

Referring to FIG. 2, a single-cavity SIW filter 20 has the same elements as the filter 10 of FIG. 1, but the microstrip line 16 is at 90° w.r.t. the microstrip line 15. An oversized cavity 29 of the filter 20 supports two modes of propagation of an electromagnetic signal, the $TE_{101}$ mode and the $TE_{201}$ mode. The SIW cavity 29 is termed herein as "oversized $TE_{101}$/$TE_{201}$ SIW cavity". The coupling between the input and the output microstrip lines 15 or 16 and the higher-order $TE_{201}$ mode can reverse when the relative position of the lines 15 and 16 changes from the same half of the SIW cavity 29 to the opposite half of the cavity 29. This coupling, which reaches a maximum when the input and the output are at an angle of 90°, can be adjusted by changing the relative position of the input and the output microstrip lines 15 and 16 and the size of the SIW cavity 29. Therefore, a finite TZ can be on the lower-frequency side or the higher-frequency side of the resonance of the higher-order $TE_{201}$ mode, and can be positioned slightly closer to the resonance of the fundamental $TE_{101}$ mode, to further improve the stopband performance of the filter 20.

Figure 3:
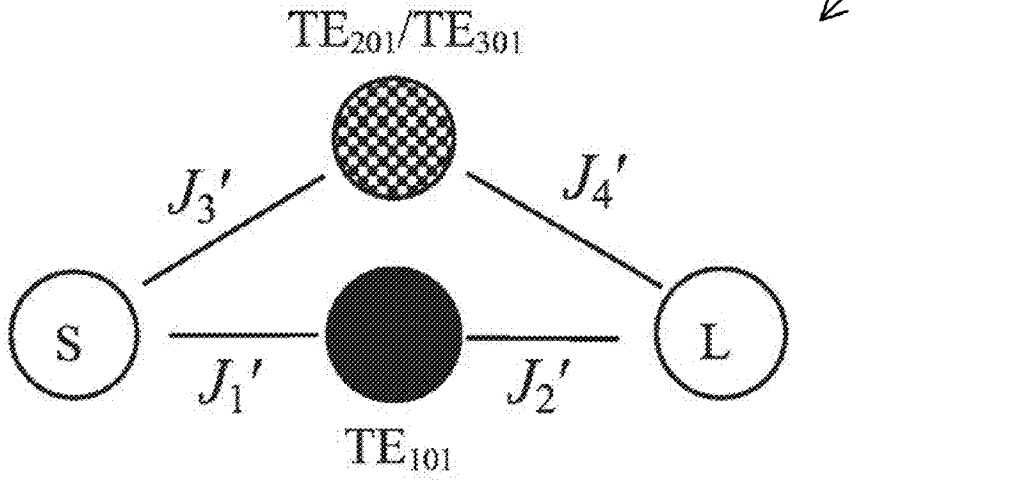
FIG. 3 is an equivalent circuit model for the mode coupling in the SIW cavities of FIGS. 1 and 2.

Turning now to FIG. 3, an equivalent circuit model 30 for the mode coupling in the SIW cavities 19 and 29 of FIGS. 1 and 2 is illustrated. The model 30 shows, in a symbolic form, signal paths between a source port S and a load port L. The fundamental resonant mode $TE_{101}$ generates a transmission pole in the desired passband. A second-order resonant mode $TE_{301}$ provides a different path for the signal flow between the two ports S and L corresponding to microstrip lines 15 and 16 of the SIW filter 10 from a path corresponding to the fundamental resonant mode $TE_{101}$. Similarly, a second-order resonant mode $TE_{201}$ provides a different path for the signal flow between the two ports S and L corresponding to microstrip lines 15 and 16 of the SIW filter 20 as compared to a path provided by the fundamental resonant mode $TE_{101}$. Because all the couplings $J_1'$, $J_2'$, $J_3'$, and $J_4'$ in an oversized SIW cavity of the present invention have the same sign, and $J_1'$ and $J_2'$ are much larger than $J_3'$ and $J_4'$ close to the resonant frequency of the second-order mode $TE_{201}$ or $TE_{301}$, a TZ between the resonant frequency of the $TE_{101}$ mode and the resonant frequency of the $TE_{201}$ or $TE_{301}$ mode is generated. The location of the TZ can be approximately determined by using the following relationship:

$$\omega_z' \approx -\frac{J_3'J_4'}{J_1'J_2'}B_{TE_{101}} \quad (4)$$

wherein $\omega'_z$ is the generalized angular frequency of the TZ, $J_1'$ and $J_2'$ are the generalized coupling admittances between the source port S and the load port L and $TE_{101}$ mode, and $J_3'$ and $J_4'$ are the generalized coupling admittances between the source port S and the load port L and one of $TE_{201}$ or $TE_{301}$ modes, as is denoted in FIG. 3. $B_{TE101}$ is the generalized constant susceptance of the $TE_{101}$ mode. In general, the TZ is shifted in frequency relative to the transmission pole of the fundamental mode $TE_{101}$ because the product of $J_1'$ and $J_2'$ is much larger than the product of $J_3'$ and $J_4'$ close to the resonance frequency of the $TE_{201}$ or $TE_{301}$ mode. For the oversized SIW cavity 19, the location of the TZ can be slightly tuned by changing the width of the SIW cavity 19 with little effect on the desired passband response generated by the $TE_{101}$ mode. The location of the TZ in the oversized SIW cavity 29 can be tuned by changing the relative position of the microstrip lines 15 and 16, as noted above.

Figures 4A, 4B:
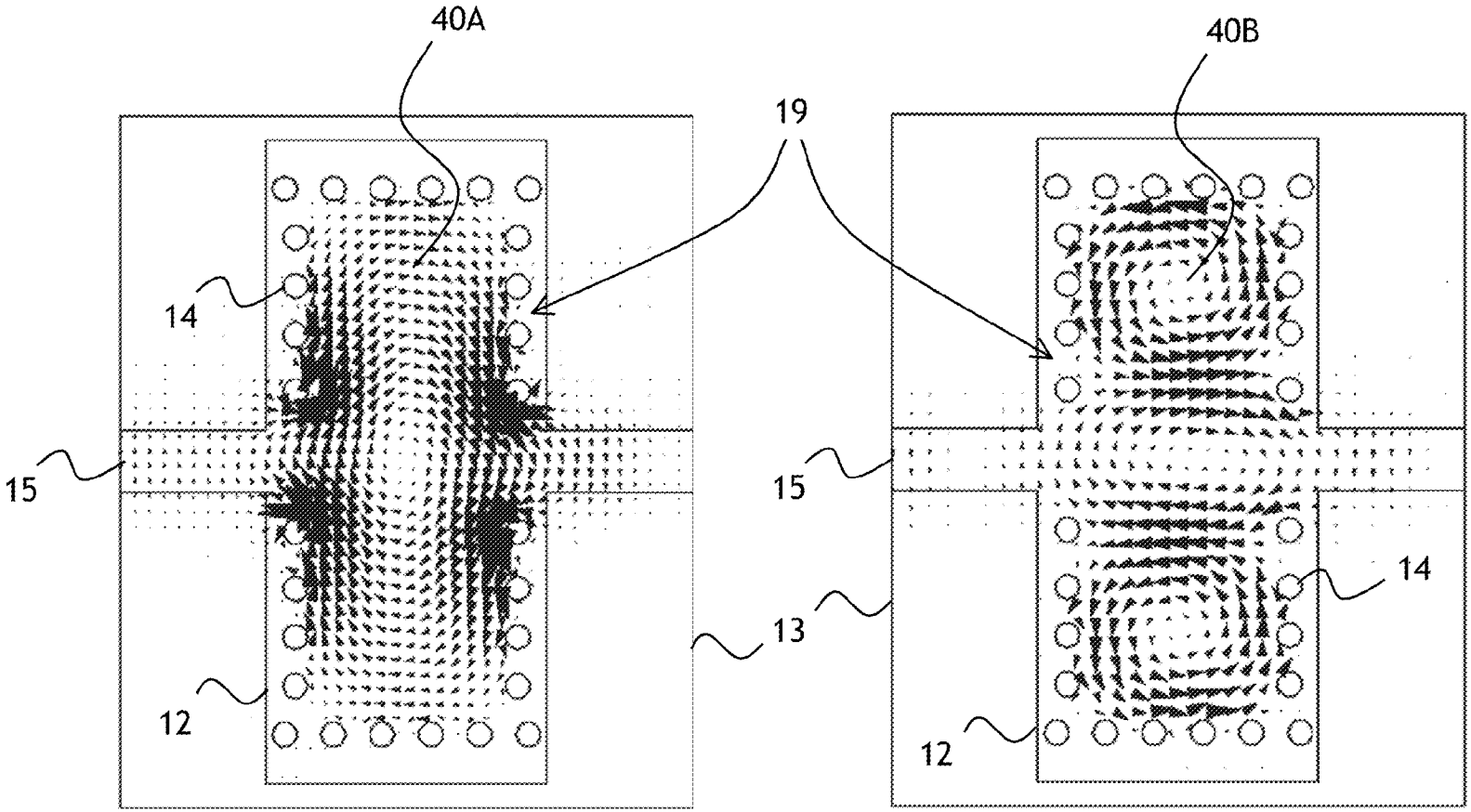
FIGS. 4A and 4B are magnetic field distributions of the fundamental mode and a higher-order mode, respectively, of the SIW filter of FIG. 1.

Turning now to FIGS. 4A and 4B, magnetic field distributions 40A and 40B of the fundamental mode $TE_{101}$ and the higher-order mode $TE_{301}$ are illustrated. The modes $TE_{101}$ and $TE_{301}$ are symmetrically excited in the SIW cavity 19 by the 50Ω microstrip line 15. The mode couplings between the microstrip line 15 and the modes $TE_{101}$ and $TE_{301}$ are both positive, the coupling between the microstrip line 15 and the $TE_{101}$ mode being significantly stronger than the coupling between the microstrip line 15 and the $TE_{301}$ mode. Thus, a TZ above the resonance of the $TE_{101}$ mode is generated; this TZ is shifted far away from the resonance of the $TE_{101}$ mode because the coupling between the microstrip line 15 and the $TE_{101}$ mode is much stronger than the coupling between the microstrip line 15 and the $TE_{301}$ mode.

Figure 5:
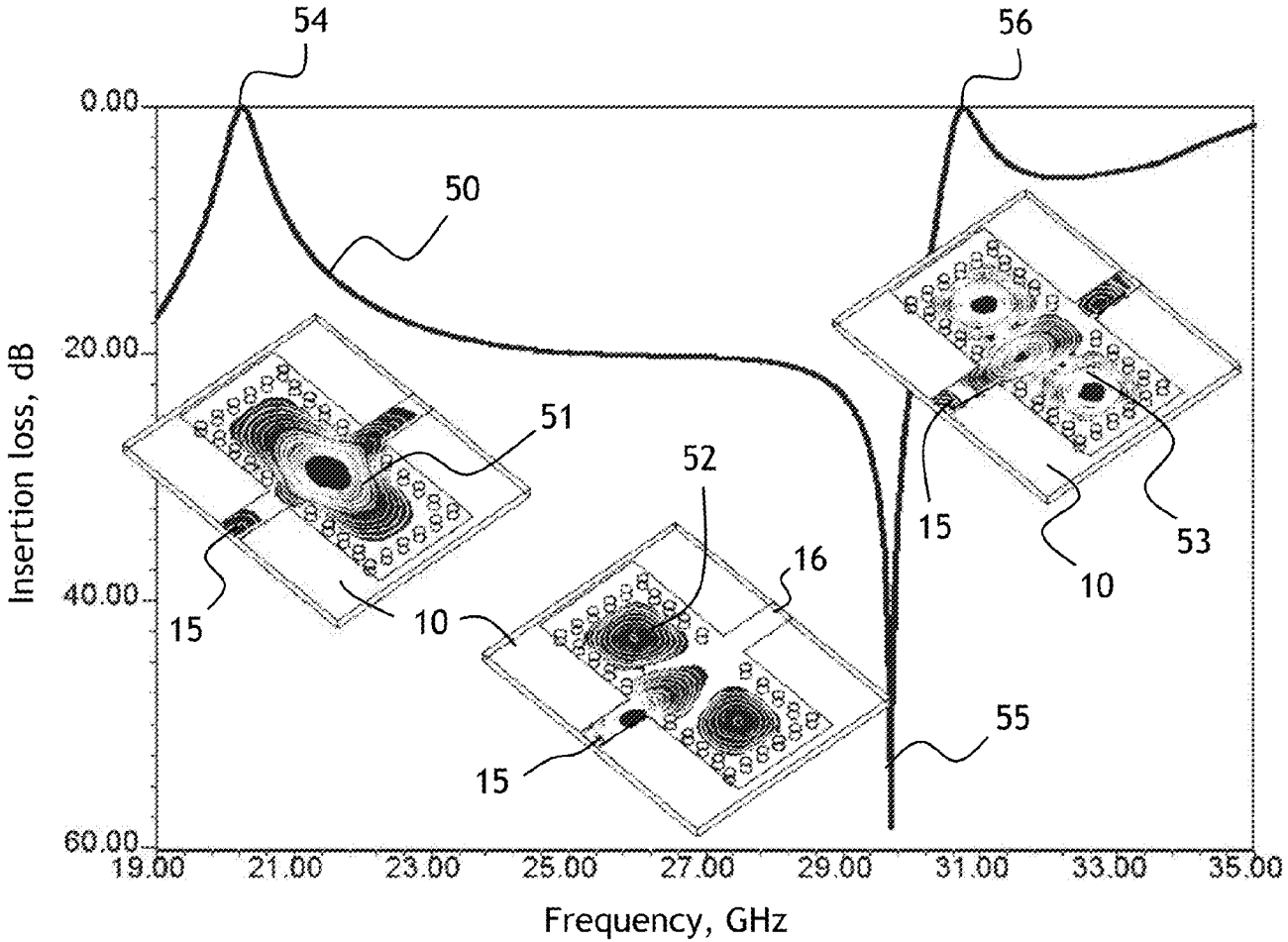
FIG. 5 is an insertion loss spectral plot for the SIW filter of FIG. 1, superimposed with electric field distribution patterns in the SIW cavity corresponding to a first transmission maximum, a first transmission zero (TZ), and a second transmission maximum.

Referring to FIG. 5, a simulated spectral plot 50 of the insertion loss of the single-cavity SIW filter 10 is shown, having superimposed thereupon electric field distributions in the SIW cavity 19 of the filter 10 corresponding to a first transmission maximum 54, a first TZ 55, and a second transmission maximum 56. A pattern 51 denotes the electric field distribution at the resonance point 54 in the SIW cavity 19 of the filter 10 excited by the input microstrip line 15. The pattern 51 corresponds to an electric field distribution of a transmission pole, when the $TE_{101}$ mode is in resonance. Similarly, patterns 52 and 53 denote the electric field distribution at the TZ 55 and at the transmission pole 56, respectively. At the point 55, the $TE_{301}$ mode is close to being in resonance, at which point it is of a sufficient strength to cancel the off-resonance mode $TE_{101}$ at the output microstrip line 16. One can see that the TZ 55 is generated at about 30 GHz, while the point of maximum transmission 54 is at 20 GHz. Advantageously, such a large distance between the TZ 55 and the transmission pole 54 is generated without resorting to placing any discriminating physical structures inside the cavity 10, such as openings in the top conductive layer 12 or the bottom conductive layer 13 of the SIW cavity 10.

Figure 6:
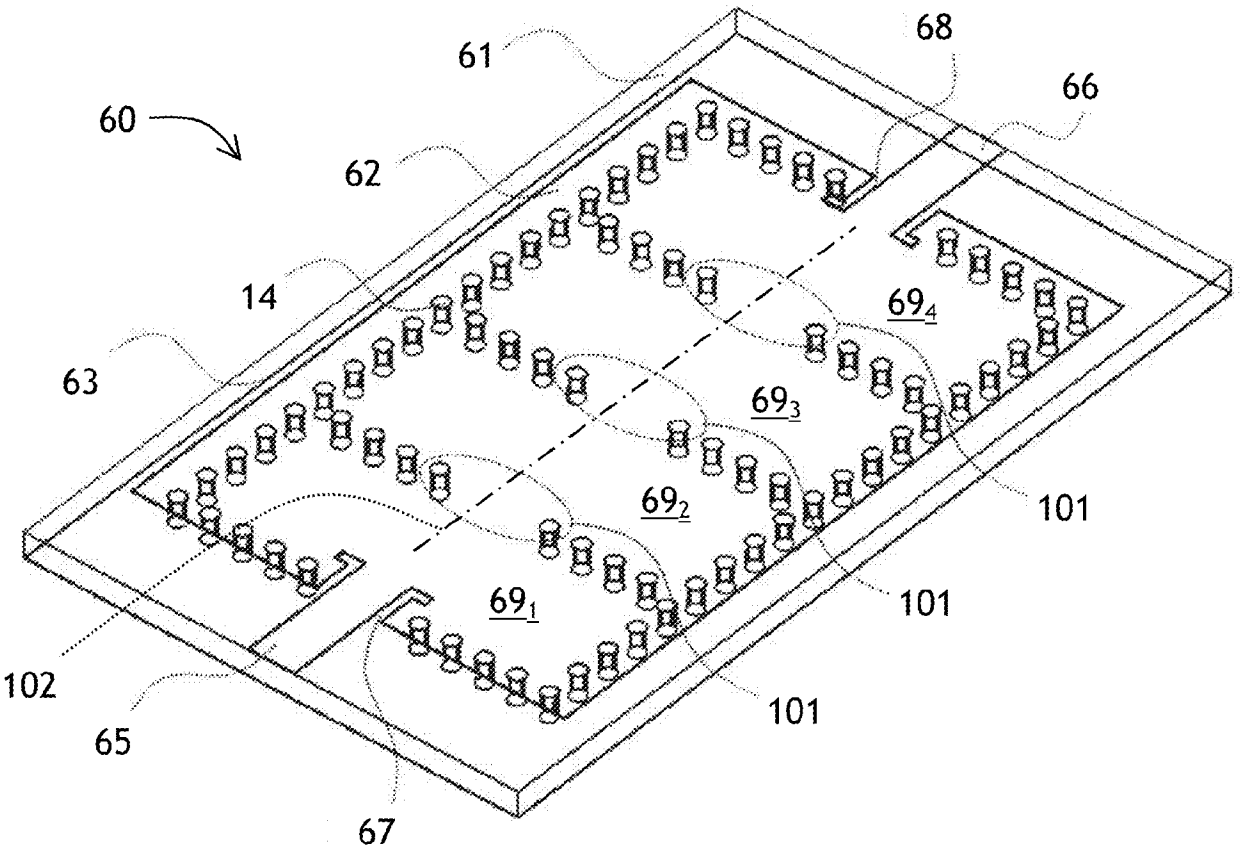
FIGS. 6, 7, and 8 are three-dimensional views of SIW filters of the present invention, having four sequentially coupled conterminous multimode SIW cavities.

Referring now to FIG. 6, a three-dimensional view of an SIW filter 60 of the present invention is shown. Similar to the single-cavity SIW filter 10 of FIG. 1, the SIW filter 60 of FIG. 6 has a dielectric layer 61 sandwiched between top and bottom opposing planar conductive layers 62 and 63, respectively. An array of the conductive vias 14 connects the conductive layers 62 and 63 through the dielectric layer 61 thereby forming a chain of four sequentially coupled conterminous multimode SIW cavities $\mathbf{69}_1$ to $\mathbf{69}_4$ defined on their perimeters by an array of the vias 14 as shown. The neighboring cavities $\mathbf{69}_1$ and $\mathbf{69}_2$; $\mathbf{69}_2$ and $\mathbf{69}_3$; and $\mathbf{69}_3$ and $\mathbf{69}_4$ are coupled to each other by a via-free opening 101 in a common wall therebetween. The SIW cavity $\mathbf{69}_1$ is directly excited by an input signal coupled to a transmission line 65, and a transmission line 66 is used to output the signal. The lines 65 and 66 are preferably microstrips, however striplines or coplanar waveguides can also be used. Inside the outer SIW cavities $\mathbf{69}_1$ and $\mathbf{69}_4$, the lines 65 and 66 are defined by non-conductive slots 67 and 68, respectively. The slots 67 and 68 have ends perpendicular to the lines 65 and 66, which facilitates improvement of the stopband performance without deteriorating the passband performance of the filter 60. Preferably, the slots 67 and 68 and the microstrips 65 and 66 are formed by patterning the top conductive layer 62. The electromagnetic signal is coupled into the first SIW cavity $\mathbf{69}_1$ by the line 65 having slots 67, and then is coupled into the next cavities $69_2$; $69_3$; and $69_4$ by the via-free openings, or "post-wall irises" 101 as shown in FIG. 6. The via-free openings are defined by eight conductive vias 14 common to perimeters of neighboring SIW cavities. At least two vias can be used for this purpose. The line 66 is used to output the electromagnetic signal from the last cavity $69_4$ of the filter 60.

According to the present invention, the size and the shape of the SIW cavities $69_1$ to $69_4$ of the filter 60 are selected to support at least two modes of propagation for passband frequency components and for stopband frequency components of the electromagnetic signal. At least two modes of each stopband frequency component cancel each other at TZs upon propagating through the chain of the SIW cavities $69_1$ to $69_4$, thereby suppressing the stopband frequency components. Preferably, the output transmission line 66 is positioned at one of these TZs, so that the two modes of each stopband frequency component cancel each other upon propagating through the filter 60. The output transmission line 66 may be disposed co-planar with the top conductive layer 62, as is shown in FIG. 6, or, alternatively, it may be co-planar with the bottom conductive layer 63.

The position of the TZs is dependent on the position of the input transmission line 65 and the shape of the SIW cavities $69_1$ to $69_4$. A specific example of dimensions of the filter 60 suitable for $K_a$-band performance will be given below. Spatial distributions of the electric field in a filter having similar geometry as the filter 60 are shown in FIGS. 9A and 9B, to be discussed later.

The stopband frequency components are suppressed at the prescribed finite TZs produced by corresponding oversized SIW cavities. Preferably, each SIW cavity $69_1$ to $69_4$ is of such shape and size that the two modes of at least a fraction of the stopband frequency components cancel each other upon propagating through a corresponding SIW cavity. Shifting the frequencies of TZs of the SIW cavities $69_1$ to $69_4$ relative to each other results in broadening of the stopband of the filter 60, while still attaining high levels of attenuation in the stopband.

Figure 7:
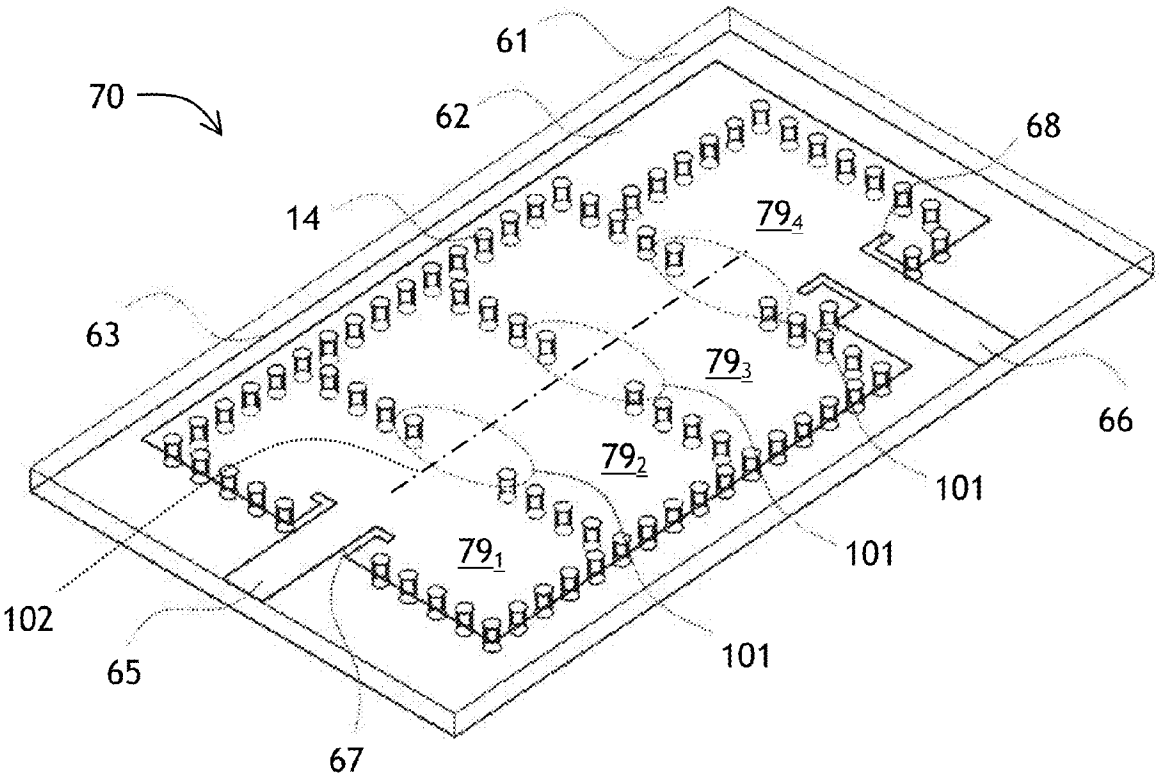
Figure 8:
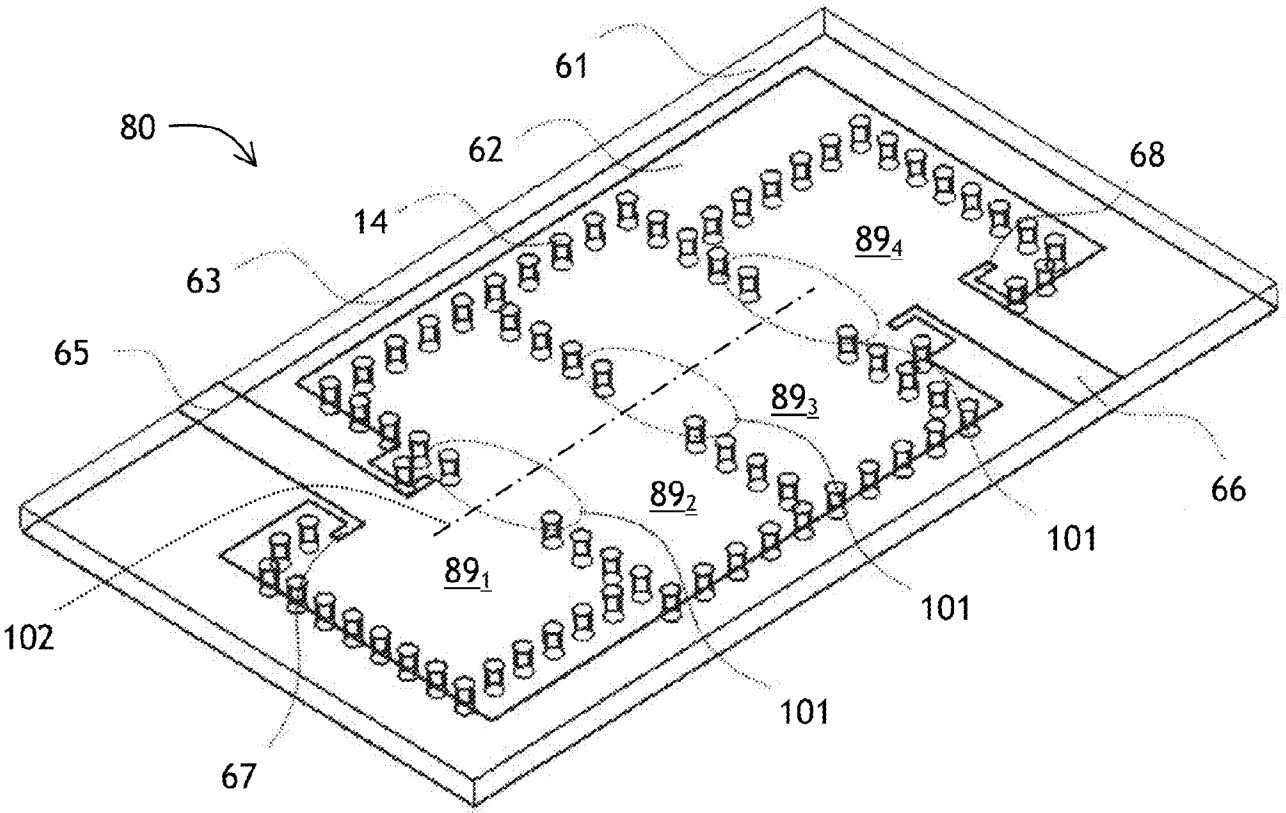

Turning to FIGS. 7 and 8, three-dimensional views of SIW filter 70 and 80 of the present invention are shown, respectively. The SIW filter 70 has SIW cavities $79_1$ to $79_4$, and the SIW filter 80 has SIW cavities $89_1$ to $89_4$. What is different between the SIW filters 60, 70, and 80 of FIGS. 6, 7, and 8, is the position of the input microstrip lines 65 and the output microstrip lines 66 relative to a longitudinal axis 102. Specifically, in the SIW filter 60, the microstrip lines 65 and 66 are parallel to the axis 102; in the SIW filter 70, the microstrip line 65 is parallel to the axis 102 while the microstrip line 66 is perpendicular to the axis 102; and in the SIW filter 80, both microstrip lines 65 and 66 are perpendicular to the axis 102. Accordingly, the SIW cavities $69_1$ to $69_4$; $79_1$ to $79_3$; and $89_2$ and $89_3$ are oversized $TE_{101}/TE_{301}$ SIW cavities; and the SIW cavities $79_4$, $89_1$, and $89_4$ are oversized $TE_{101}/TE_{201}$ SIW cavities. Varying orientations of the microstrip lines 65 and 66 allow fine tuning of the TZ frequencies of a first and a last SIW cavity in a chain of consecutively coupled SIW cavities, in a similar manner to tuning the TZ frequencies of the SIW cavity 29 of FIG. 2.

Figure 9A:
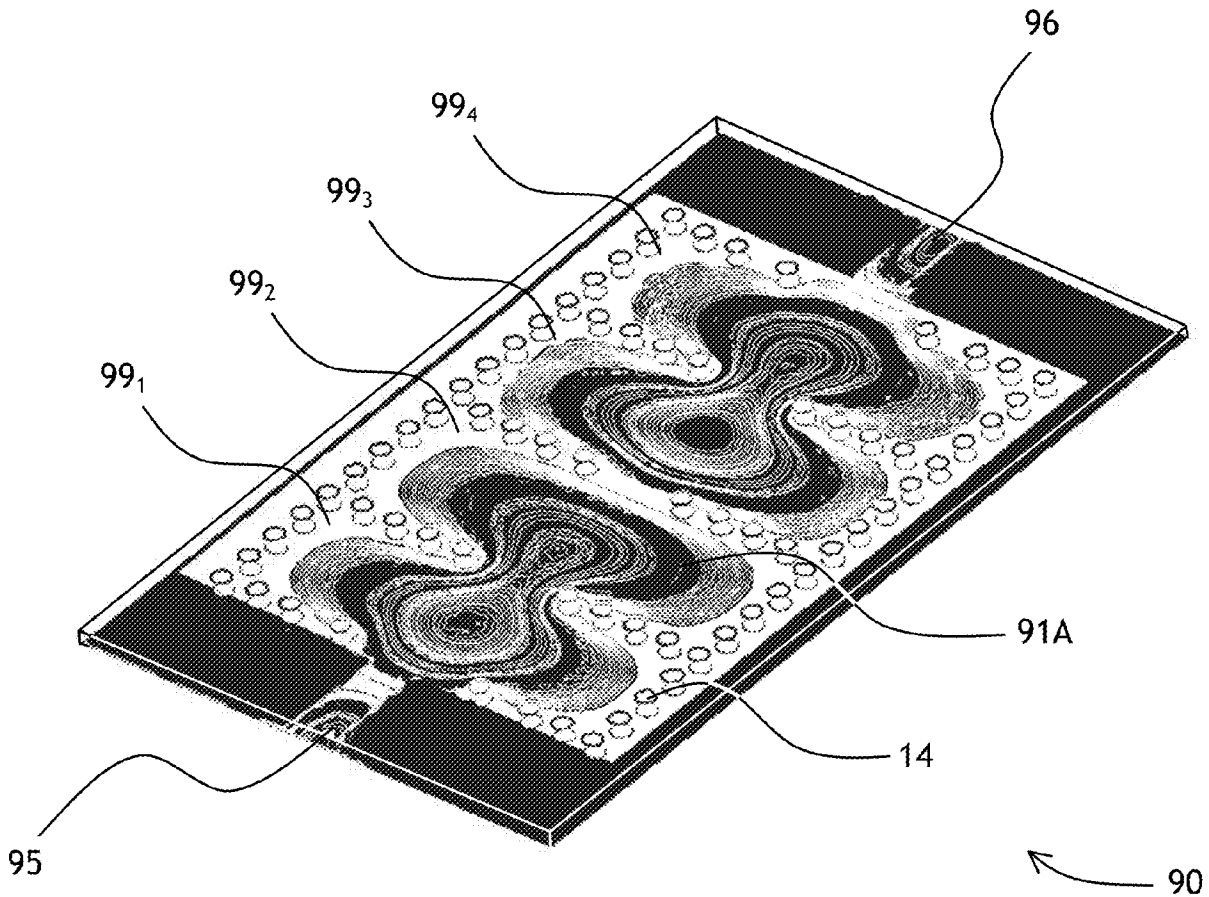
FIGS. 9A and 9B are electric field distribution patterns in a four-cavity SIW filter at a fundamental passband and a spurious passband frequency of a signal, respectively.
Figure 9B:
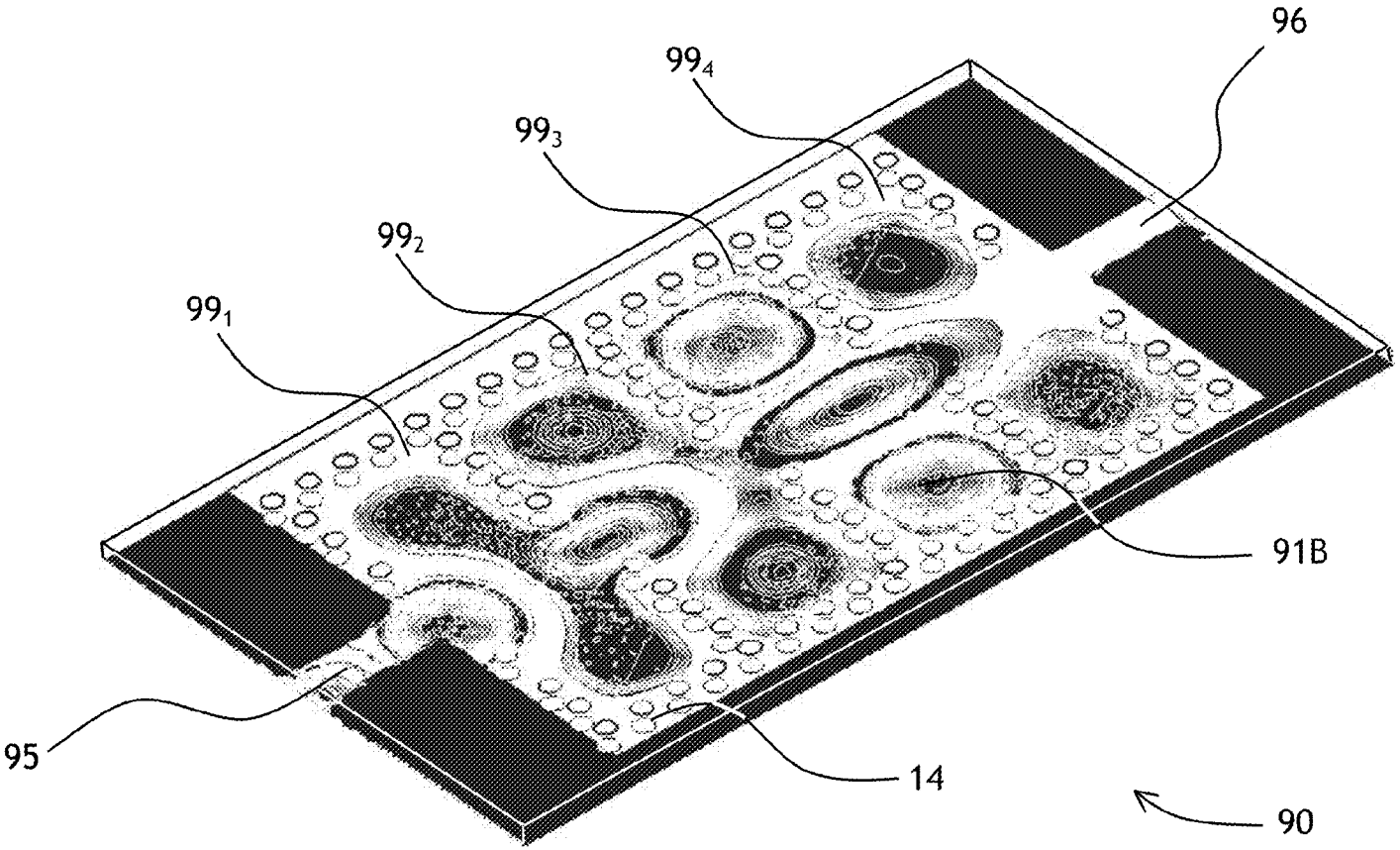

Referring now to FIGS. 9A and 9B, simulated electric field distribution patterns 91A and 91B in the SIW cavities $99_1$ to $69_4$ of the filter 90 are shown. The filter 90 has the same general geometry as the filter 60 of FIG. 6, having input and output microstrip lines 95 and 96, respectively, and $TE_{101}/TE_{301}$ SIW cavities $99_1$ to $99_4$. The patterns 91A and 91B correspond to electromagnetic signals at a fundamental passband frequency and a spurious passband frequency, respectively. The resonant mode of the fundamental passband is the $TE_{101}$ mode, while the resonant mode of the spurious passband is the $TE_{301}$ mode.

Figure 10:
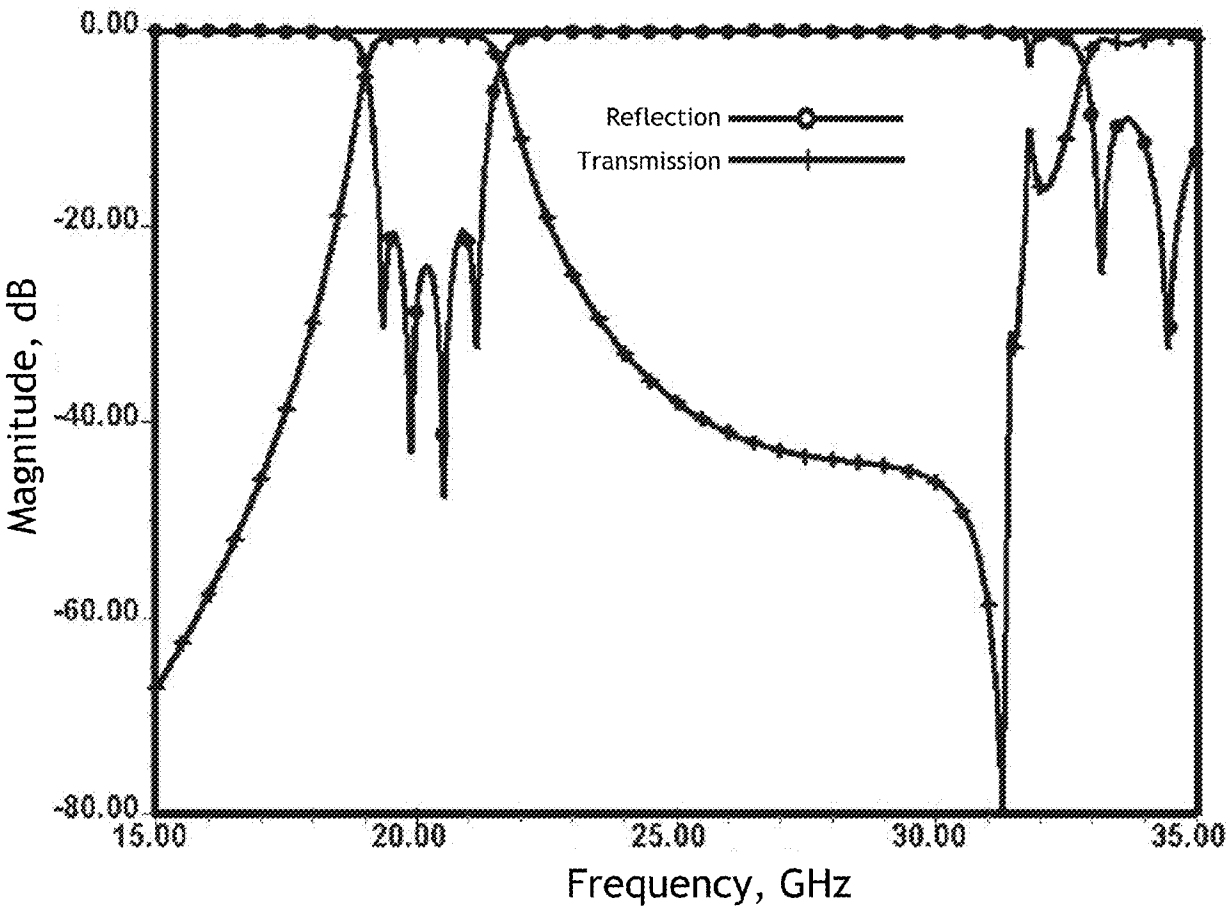
FIGS. 10 to 12 are spectral plots of transmission and reflection of the SIW filters of FIGS. 6 to 8, respectively.
Figure 11:
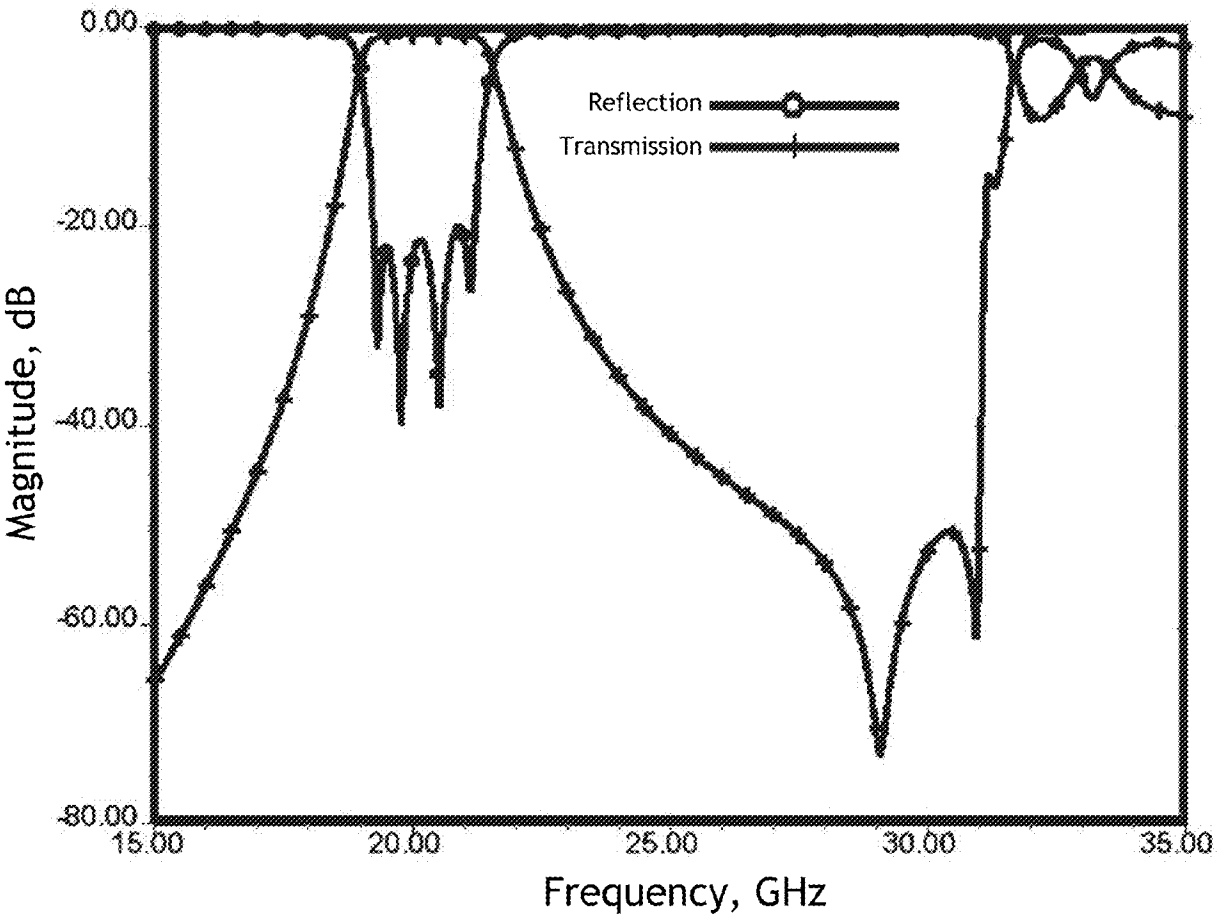
Figure 12:
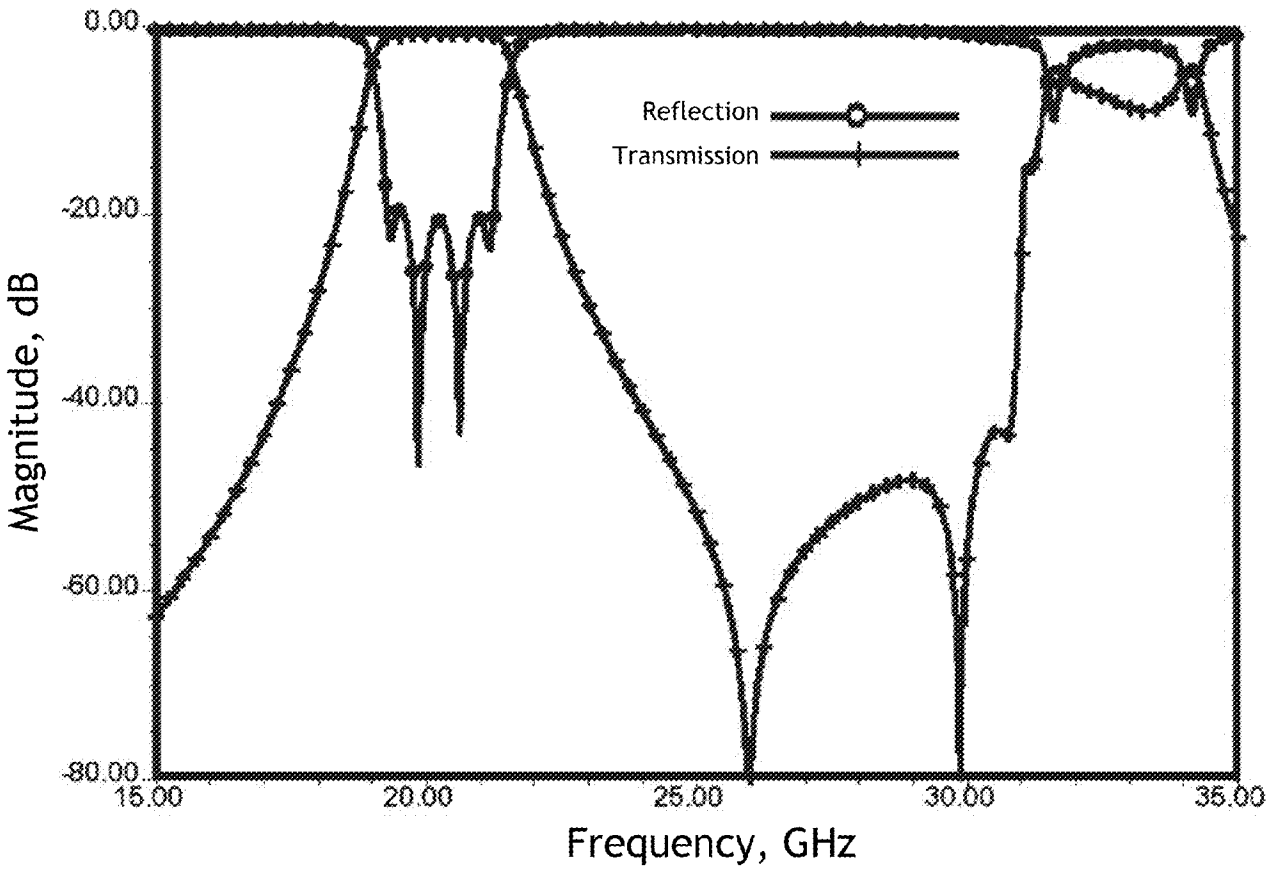

Turning now to FIGS. 10 to 12, simulated transmission and reflection response characteristics of the SIW filters 60, 70, and 80 of FIGS. 6, 7, and 8 are shown, respectively. The filters 60, 70, and 80 are exemplary embodiments of a $K_a$-band filter. In a $K_a$-band satellite communications ground terminal, the transmission occurs at 29.5 to 30 GHz, while the reception occurs within 19.2-21.2 GHz. A receiving filter is normally used for suppressing a 29.5-30 GHz transmission signal to prevent self-jamming, while conveying a 19.2-21.2 GHz signal to be received by a receiver. One can see that the stopband rejection over the satellite transmit frequency band of 29.5-30 GHz, seen in FIG. 10, is close to 45 dB. Furthermore, in FIGS. 11 and 12, the stopband rejection of the filters 70 and 80 over the satellite transmit frequency band of 29.5-30 GHz is better than 50 dB, although only four multimode SIW cavities are used to arrive at a low insertion loss of 0.5-0.7 dB. An alternative way of defining the performance of the filters 60, 70, and 80 as seen from FIGS. 10 to 12, is to define a 3 dB passband and a 35 dB stopband. The 3 dB bandwidth of the passband in FIGS. 10 to 12 is at least 10% of a center frequency $f_P$=20.2 GHz of the passband, that is, a middle frequency of the 3-dB points defining the passband. The 35 dB bandwidth of the stopband is at least 2% of a center frequency $f_S$=29.75 GHz of the stopband, that is, a middle frequency of the 35-dB points defining the stopband. This performance is achieved at the stopband located away from the passband, so that $f_S-f_P>0.3*f_P$.

Figure 13:
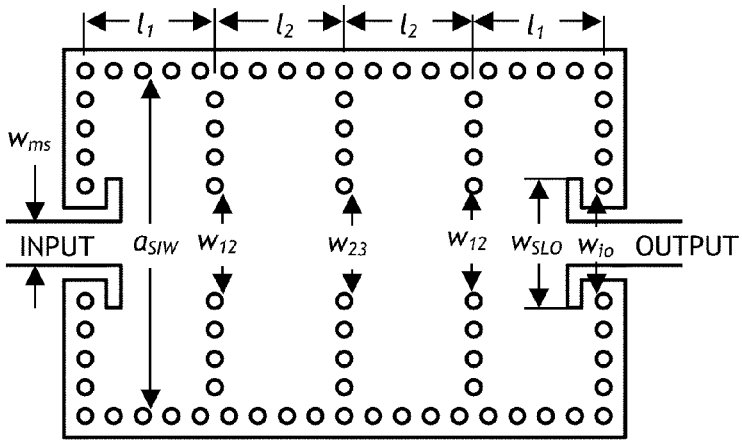
FIGS. 13 to 15 are plan views of SIW filters of FIGS. 6 to 8, respectively, showing dimension notations of the filters.
Figure 14:
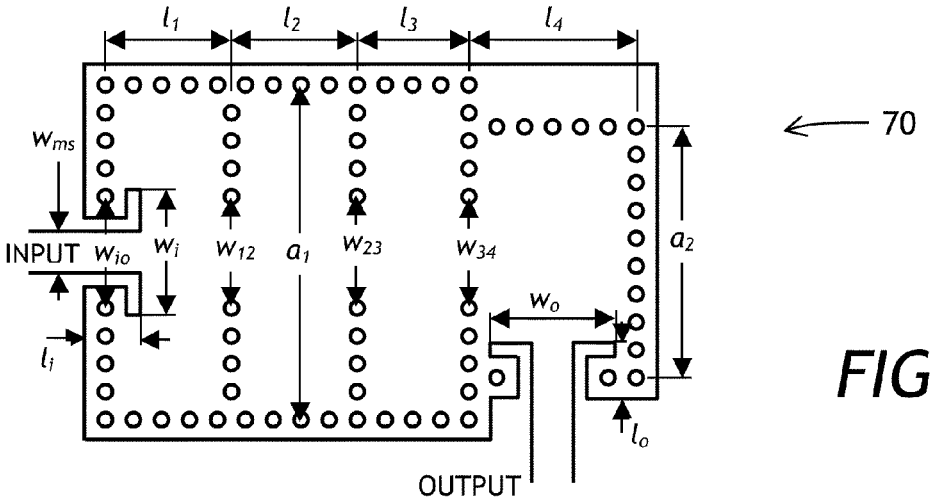
Figure 15:
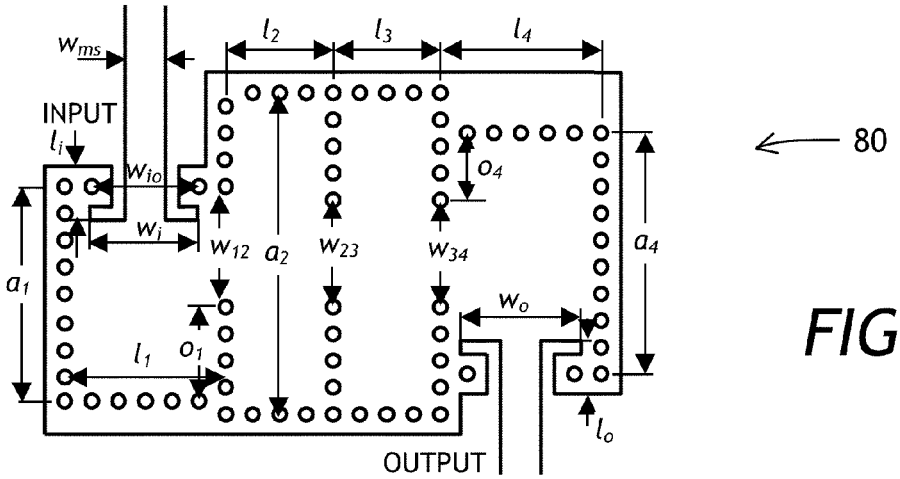

Referring to FIGS. 13 to 15, plan views of SIW filters of the present invention are presented. The views of FIGS. 13, 14, and 15 show notations of the main dimensions of the filters 60, 70, and 80, respectively. Tables 1 to 3 below show example dimensions of the corresponding $K_a$-band filters, in accordance with the notations of FIGS. 13 to 15.

TABLE 1

| for FILTER 60 | | | |
|---|---|---|---|
| $w_{io}$ | 3.22 mm | $l_1$ | 4.46 mm |
| $w_{12}$ | 3.19 mm | $l_2$ | 4.54 mm |
| $w_{23}$ | 2.99 mm | $a_{SIW}$ | 10.5 mm |
| $w_{ms}$ | 1.28 mm | $w_{SLO}$ | 2.56 mm |

TABLE 2

| for FILTER 70 | | | |
|---|---|---|---|
| $w_{ms}$ | 1.28 mm | $w_{12}$ | 3.19 mm |
| $w_{io}$ | 3.22 mm | $w_{23}$ | 2.99 mm |
| $w_i$ | 2.56 mm | $w_{34}$ | 3.24 mm |
| $l_i$ | 1.48 mm | $a_1$ | 10.66 mm |
| $l_1$ | 4.46 mm | $a_2$ | 6.60 mm |
| $l_2$ | 4.54 mm | $w_o$ | 3.14 mm |
| $l_3$ | 4.53 mm | $l_o$ | 1.6 mm |
| $l_4$ | 5.35 mm | | |

TABLE 3

| for FILTER 80 | | | |
|---|---|---|---|
| $w_{ms}$ | 1.28 mm | $w_{23}$ | 2.99 mm |
| $w_{io}$ | 3.08 mm | $w_{34}$ | 3.24 mm |
| $w_i$ | 2.88 mm | $a_1$ | 6.6 mm |
| $l_i$ | 1.50 mm | $a_2$ | 10.75 mm |
| $l_1$ | 5.43 mm | $a_4$ | 6.6 mm |

TABLE 3-continued

| for FILTER 80 | | | |
|---|---|---|---|
| $l_2$ | 4.47 mm | $w_o$ | 3.14 mm |
| $l_3$ | 4.52 mm | $l_o$ | 1.6 mm |
| $l_4$ | 5.35 mm | $o_1$ | 3.14 mm |
| $w_{12}$ | 3.46 mm | $o_4$ | 2.11 mm |

A skilled artisan will realize that the filter shapes and sizes, defined by the sets of dimensions tabulated in Tables 1 to 3, are not the only possible shapes and sizes of a $K_a$-band filter of the present invention. Furthermore, for another passband and stopband frequency and attenuation level specification, as well as for another dielectric layer material, the dimensions can be different. It is to be understood, however, that the invention encompasses various sizes and shapes of SIW cavities that support two modes, so that the two modes cancel each other upon propagating through the sequential chain of the SIW cavities, thereby suppressing the stopband frequency components at defined TZ locations. As is appreciated by one skilled in the art, the above described "mode cancelling" function will determine the shape and size of SIW cavities. In particular, one can observe from the Tables 1 to 3 that individual SIW $TE_{101}/TE_{301}$ cavities are more than twice as wide as they are long. One can also observe that the individual SIW cavities are more than three times as wide as the width of the corresponding via-free openings. As for the size of the SIW cavities, for a $K_a$-band application, the $TE_{101}/TE_{301}$ cavities are preferably 8 mm to 14 mm wide, the $TE_{101}/TE_{201}$ cavities are between 5 mm to 8 mm wide, with the total length of the entire chain of four cavities being in the range of 16 mm to 22 mm. The size of the cavities may vary and depends on the dielectric constant of the substrate material used.

The filters 60, 70, and 80 are preferably manufactured in a PCB having linear arrays of metalized via holes with a diameter of 0.5 mm and a center-to-center pitch of 1 mm, although other pitch dimensions that are fine enough to prevent radiation losses may be used. For the PCB, a 20 mil thick RT/Duroid™ 6002 or 20 mil thick RT/Duroid 5880 PCB material may be used. Both materials are supplied by Rogers Corp., having headquarters in Rogers, Conn., USA. In theory, the unloaded quality factor Qu of an SIW resonator based on 20 mil thick Rogers RT/Duroid 5880 is about 500, while the Qu of an SIW resonator based on 20 mil thick Rogers RT/Duroid 6002 is only about 350. Hence, the RT/Duroid 5880 substrate is expected to be beneficial from the insertion loss standpoint. In reference to Eq. (2) above, both Qd and Qc of an SIW cavity made of RT/Duroid 5880 are higher than Qd and Qc of an SIW cavity made of RT/Duroid 6002. The Qd is higher because of a lower loss tangent tan(D). The Qc is higher for the RT/Duroid 5880 because of larger cavity dimensions, due to a lower dielectric constant as compared to Rogers RT/Duroid 6002.

Both abovementioned Rogers substrates use a similar fabrication process and have a similar fabrication cost. However, RT/Duroid 6002 has better mechanical properties than RT/Duroid 5880. The RT/Duroid 6002 material is suitable for laser drilling, and via holes of a wide range of diameters can be drilled by this method. The RT/Duroid 5880 material must be mechanically drilled, and mechanical drilling generally has a lower degree of precision than laser drilling. The better suitability for machining of the RT/Duroid 6002 material makes it preferable over the RT/Duroid 5880 material, even though the 5880 material has a better electrical performance as explained above. The filters 60, 70, and 80 were designed and fabricated using 20 mil thick Rogers RT/Duroid 6002 material.

Figure 16:
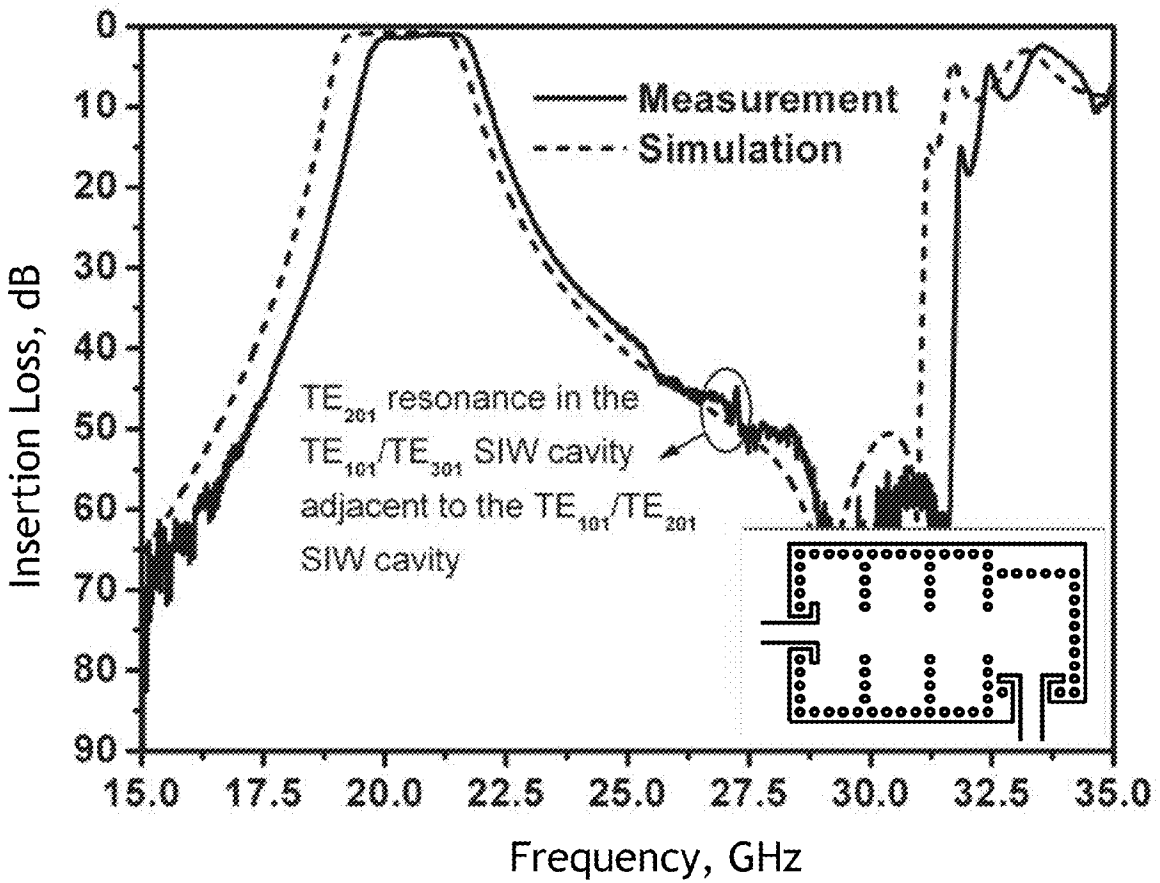
FIG. 16 is a comparative spectral plot of simulated and measured insertion loss of a SIW filter of FIG. 7.

Turning now to FIG. 16, spectral plots of simulated and measured insertion loss of the SIW filter 70 of FIG. 7 are presented. A variation of the dielectric constant of the substrate and a fabrication error led to a slight frequency shift of about 1.5% between the simulated and the measured responses. The measured minimum in-band insertion loss is approximately 0.9 dB, which is slightly higher than the simulated loss of 0.75 dB due to the additional loss of a 90° microstrip bend, not shown, and an additional section of microstrip line, not shown. There is a maximum variation of about 0.6 dB in the insertion loss across the passband. The attenuation in the frequency band of 25.3 GHz-31.7 GHz is better than 40 dB, while in the transmission (Tx) band of 29.5 GHz-30 GHz it is better than 58 dB. There is a spike around 31.7 GHz due to higher-order resonances of the $TE_{201}$ mode and $TE_{301}$ mode.

Figure 17:
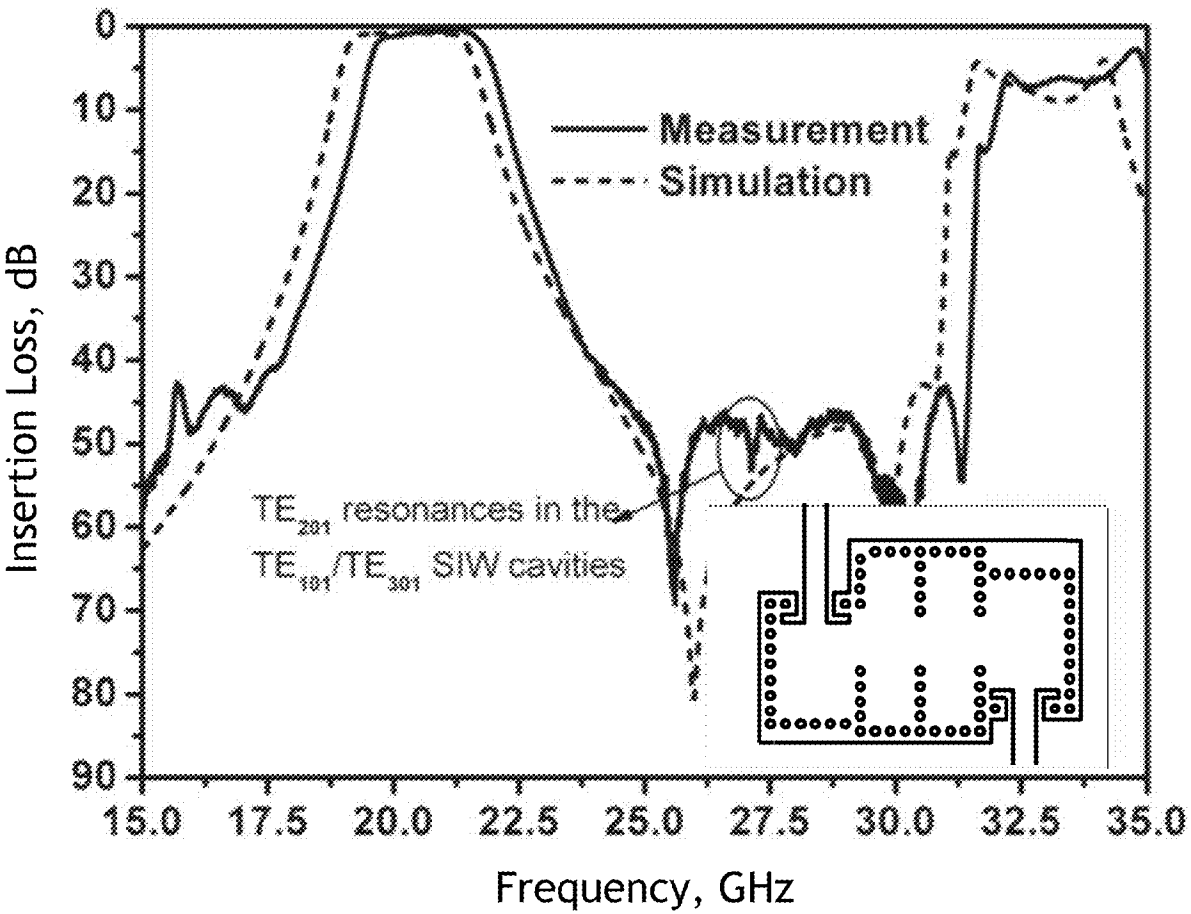
FIG. 17 is a comparative spectral plot of simulated and measured insertion loss of a SIW filter of FIG. 8.

Referring now to FIG. 17, spectral plots of simulated and measured insertion loss of the SIW filter 80 of FIG. 8 are presented. Similar to the spectral plot of FIG. 16, a slight frequency shift of about 1.3% between the simulated and measured responses occurs due to the variation of the dielectric constant of the substrate, as well as due to fabrication tolerances. The measured minimum in-band insertion loss is around 0.8 dB, which is very close to the simulated loss of 0.77 dB. The attenuation in the frequency band of 23.94 GHz-31.48 GHz is better than 40 dB, while in the Tx band of 29.5 GHz-30 GHz it is better than 52 dB. There is a spike around 31.6 GHz due to the higher-order resonances of the $TE_{201}$ mode and $TE_{301}$ mode.

What is claimed is:

1. A waveguide filter having a passband and a stopband, for conveying passband frequency components of an electromagnetic signal, while suppressing stopband frequency components of the electromagnetic signal, the filter comprising:

a substrate integrated waveguide (SIW) formed in a dielectric layer sandwiched between first and second opposing planar conductive layers, the SIW having a chain of sequentially coupled conterminous multimode SIW cavities defined on their perimeters by an array of conductive vias connecting the first and the second conductive layers through the dielectric layer, the chain having first and second ends;

an input transmission line coupled to the first end of the chain, for coupling the electromagnetic signal to the first end of the chain; and an output transmission line coupled to the second end of the chain, for outputting the passband frequency components of the electromagnetic signal from the second end of the chain;

wherein a distance between neighboring vias of the array of conductive vias is less than one half of a shortest wavelength of the electromagnetic signal in the SIW cavities, wherein each SIW cavity is sized and shaped to support a fundamental mode of propagation and a higher-order mode of propagation of the electromagnetic signal, wherein the passband is defined by the fundamental mode, and the stopband is defined by a destructive interference between the fundamental and the higher order modes.

2. A waveguide filter of claim 1, wherein the input and the output transmission lines are disposed so that the fundamental and the higher order modes of each stopband frequency component cancel each other upon propagating through the chain of the SIW cavities, thereby suppressing the stopband frequency components.

3. A waveguide filter of claim 1, wherein the electromagnetic signal has a frequency range of between 5 GHz and 60 GHz.

4. A waveguide filter of claim 1, wherein the first and the second conductive layers within the perimeter of each SIW cavity are void of openings.

5. A waveguide filter of claim 2, wherein each SIW cavity is of such size and shape that the fundamental and the higher order modes of at least some of the stopband frequency components cancel each other upon propagating through each SIW cavity.

6. A waveguide filter of claim 2, wherein each SIW cavity is of a substantially rectangular shape.

7. A waveguide filter of claim 2, wherein the fundamental and the higher order modes comprise $TE_{101}$ and $TE_{301}$ modes, respectively.

8. A waveguide filter of claim 2, wherein the fundamental and the higher order modes comprise $TE_{101}$ and $TE_{201}$ modes, respectively.

9. A waveguide filter of claim 2, wherein a 3 dB bandwidth of the passband is at least 10% of a central frequency $f_P$ thereof, wherein a 35 dB bandwidth of the stopband is at least 2% of a central frequency $f_S$ thereof, and wherein $f_S - f_P > 0.3 * f_P$.

10. A waveguide filter of claim 2, wherein each two neighboring SIW cavities have a common wall therebetween defined by at least two of the conductive vias, and wherein each two neighboring SIW cavities are coupled to each other by a via-free opening in the common wall therebetween.

11. A waveguide filter of claim 10, wherein the input transmission line has a first conductive strip attached to the dielectric layer, wherein the first conductive strip is co-planar with, and electrically coupled to, the first conductive layer, and wherein the input transmission line is selected from a group consisting of a microstrip, a stripline, and a coplanar waveguide.

12. A waveguide filter of claim 11, wherein the first conductive strip is patterned in the first conductive layer, being defined by two non-conductive slots on opposing sides of the conductive strip, for improving a stopband performance of the waveguide filter, wherein each of the two non-conductive slots has an end disposed within a first of the SIW cavities in the chain of the SIW cavities.

13. A waveguide filter of claim 12, wherein the ends of the non-conductive slots extend perpendicular to the first conductive strip.

14. A waveguide filter of claim 11, wherein the SIW comprises four SIW cavities disposed along a longitudinal axis.

15. A waveguide filter of claim 14, wherein the first conductive strip is parallel to the longitudinal axis.

16. A waveguide filter of claim 14, wherein the first conductive strip is perpendicular to the longitudinal axis.

17. A waveguide filter of claim 14, wherein the output transmission line has a second conductive strip on the dielectric layer, wherein the second conductive strip is co-planar with, and electrically coupled to, the first conductive layer or the second conductive layer, wherein the output transmission line is selected from a group consisting of a microstrip, a stripline, and a coplanar waveguide.

18. A waveguide filter of claim 17, wherein the second conductive strip is parallel to the longitudinal axis.

19. A waveguide filter of claim 17, wherein the second conductive strip is perpendicular to the longitudinal axis.

20. A waveguide filter of claim 14, wherein each SIW cavity has a length measured along the longitudinal axis, and a width measured across the longitudinal axis, and wherein at least two of the SIW cavities are at least twice as wide as they are long.

21. A waveguide filter of claim 14, wherein the via-free opening has a width, and wherein at least two conterminous SIW cavities are at least three times as wide as the width of the via-free opening therebetween.

22. A waveguide filter of claim 14, wherein the width of at least two SIW cavities is between 8 mm and 14 mm, and wherein the sum length of the chain of the SIW cavities, measured along the longitudinal axis, is between 16 mm and 22 mm.

23. A waveguide filter having a passband and a stopband, for conveying passband frequency components of an electromagnetic signal, while suppressing stopband frequency components of the electromagnetic signal, the filter comprising:

a multimode substrate integrated waveguide (SIW) cavity formed in a dielectric layer sandwiched between first and second opposing planar conductive layers, wherein the SIW cavity is defined on its perimeter by an array of conductive vias connecting the first and the second conductive layers through the dielectric layer;

input and output locations for coupling the electromagnetic signal to the SIW cavity, and outputting the electromagnetic signal from the SIW cavity, respectively;

wherein a distance between neighboring vias of the array of conductive vias is less than one half of a shortest wavelength of the electromagnetic signal in the SIW cavity; and wherein the SIW cavity is sized and shaped to support a fundamental mode of propagation and a higher-order mode of propagation of the electromagnetic signal, wherein the passband is defined by the fundamental mode, and the stopband is defined by a destructive interference between the fundamental and the higher order modes of propagation.

* * * * *